US008622650B2

(12) United States Patent
Lifton

(10) Patent No.: US 8,622,650 B2
(45) Date of Patent: Jan. 7, 2014

(54) MULTI-PURPOSE ROTATIONAL BARRIER UNIT

(76) Inventor: Robert Lifton, Jupiter, FL (US)

( * ) Notice: Subject to any disclaimer, the term of this patent is extended or adjusted under 35 U.S.C. 154(b) by 194 days.

(21) Appl. No.: 12/875,630

(22) Filed: Sep. 3, 2010

(65) Prior Publication Data

US 2012/0057935 A1 Mar. 8, 2012

(51) Int. Cl.
*E02B 15/04* (2006.01)
*E02B 3/04* (2006.01)
*E01F 13/02* (2006.01)

(52) U.S. Cl.
USPC ..... 405/65; 405/26; 404/6

(58) Field of Classification Search
USPC ..... 405/21, 26, 33, 35, 63, 64, 65, 70, 71; 404/6–8
See application file for complete search history.

(56) References Cited

U.S. PATENT DOCUMENTS 226,663 A * 4/1880 Kirkup ..... 405/26
3,673,805 A * 7/1972 Szyfter ..... 405/26
3,685,297 A * 8/1972 Juodis et al. ..... 405/68
4,059,362 A 11/1977 Smith
4,712,944 A * 12/1987 Rose ..... 405/26
5,498,101 A 3/1996 Braverman
7,140,599 B1 * 11/2006 Spink ..... 256/13
7,144,187 B1 * 12/2006 Nolte et al. ..... 404/6
7,407,341 B2 8/2008 Yodock, Jr. et al.
7,731,452 B2 6/2010 Yodock, III et al.
2003/0035690 A1 * 2/2003 Earl ..... 405/107
2004/0115003 A1 * 6/2004 Johnston ..... 405/63
2004/0197148 A1 * 10/2004 Gould ..... 405/63
2012/0003045 A1 * 1/2012 Singleton ..... 405/63

* cited by examiner

*Primary Examiner* — David Bagnell
*Assistant Examiner* — Kyle Armstrong
(74) *Attorney, Agent, or Firm* — McHale & Slavin, P.A.

(57) ABSTRACT

The instant invention describes a multi-purpose rotational barrier unit and a system of interconnected barrier units which function in multiple environments, including aquatic environments and land-based environments. The multi-purpose rotational barrier unit has a design configuration which provides hydro-dynamic stability in strong currents and high waves and resists roll over. The multi-purpose rotational barrier unit comprises a plurality of equally sized walls interconnected to form side walls and a bottom wall. Connected to the side walls and the bottom wall are two opposing end walls which define a hollow interior portion. The opposing end walls contain one or more rotation members which are constructed and arranged to provide the barrier unit rotational movement which is independent from the movement of other barrier units directly attached to its opposing walls or units which may indirectly be attached as part of a larger barrier wall system.

20 Claims, 14 Drawing Sheets

MULTI-PURPOSE ROTATIONAL BARRIER UNIT

FIELD OF THE INVENTION

The instant invention relates to barrier devices useful in aquatic environments to contain materials, such as oil, floating on the surface of the water, as well as inland based environments, such as along roadways and construction sites; and more particularly to a multi-purpose rotational barrier unit which is constructed to maintain it original configuration during roll-over as a result of rough seas and to rotate independently relative to adjacently attached units if in a larger barrier wall assembly.

BACKGROUND OF THE INVENTION

The recent oil well disaster in the Gulf Coast of Mexico and the oil disaster a little over 20 years ago in the Prince William Sound illustrate the huge economic and ecological impact such spills have on the regional areas as well as nationally. While such large oil spills have been relatively infrequent, given the rise of new industrial powers in Asia and the continuous needs of the leading economic powers, the worldwide global demand for oil is expected to increase sharply. While the current political atmosphere calls for reduction in oil usage and replacement of hydrocarbons as the primary fuel source, newer green technology is currently underdeveloped, and other fuels, such as natural gas, may be too costly to implement immediately. As such, oil companies continue to find new sources of oil, which includes developing deep water well sites.

Although large oil spills tend to draw the national media's attention, other sources of spills and leaks of potentially harmful materials into the nation's waterways can be just as disastrous to the environment and local economies. Materials can be released during normal transportation as a result of damage to the hulls of ships or tankers. Contaminants such as silt, debris or other pollutants can be released into bodies of water as a result of dredging operations or construction projects undertaken at or near such bodies of water. Industrial manufacturing and processing in factories also contribute to aquatic pollution through release of its industrial wastes. Finally, while most of the contamination sources listed above are man-made, natural disasters such as floods, storms, or mudslides contribute to polluting aquatic environments.

Regardless of the source of contamination, the medical, economical, and environmental consequences of such spills can be devastating. Other than prohibiting the type of activity that causes the spills, the primary method of handling such actions is through the use of timely containment and clean-up measures. Because many contaminates will initially remain floating in the water at the spill site for a limited time, delivery of containment devices rapidly to the area is imperative for proper clean-up, ensuring that currents do not disperse the spill site over a larger area. Once in the ocean currents, effectively cleaning the containment becomes difficult if not impossible. The typical containment systems utilize barriers or boom systems. Such systems are placed at or near the spill site and are specifically devised to isolate and limit the flow of contamination outside the affected area. Most boom systems contain a buoyant cylindrical section that rests at or near the surface of the water. Attached to the cylindrical section and extending into the water is a skirt, made of water-impervious material made of non-oil absorbent materials. These typical boom systems are somewhat effective at containing spills in calm waters. However, in rough seas or stormy weather, the configuration of the boom limits the effectiveness in containing the spills. Typically encountered in rough or stormy seas are continuous wave surges having large wave sizes. Large waves tend to push the contaminated water over and above the cylindrical section of the boom. Moreover, the continued wave action may act to reorient the cylindrical portion and the skirt of the boom, thereby reducing its effectiveness. Additionally, when rough water is anticipated, these booms have to be deflated, dismantled and demobilized, significantly adding to the cost of deployment and maintenance of these types of oil containment booms.

U.S. Pat. Nos. 7,731,452 and 7,407,341 teach a floating wall of interconnected barrier units which can be readily recognized by operators of vessels and others as a warning structure delineating a restricted area. The barrier units have a shape similar to Jersey barriers, see for example U.S. Pat. No. 4,059,362, U.S. Pat. No. 5,498,101, and U.S. Pat. No. 5,747,538, commonly used at construction sites or along roadways as dividers. The individual barrier units include a top wall, a bottom wall, opposed end walls, and opposed side walls interconnected to form a hollow interior which is partially or completely filled with a foam material. A ballast weight is secured to each barrier unit to maintain them in an upright position in the water. Cables, couplers and/or other connectors are employed to mount adjacent barriers end-to-end to form a barrier wall which can encircle a vessel or otherwise isolate an area within a seaport to provide security. While the device contains ballast for maintaining an upright position, unless the units are completely anchored to the sea bed, the ballast utilized can not prevent roll-over. Fastening to the sea bed is costly and may encounter the need for environmental impact studies prior to securing. Should the individual units topple, the device is constructed in such a manner that the original positioning of the units is not maintained, resulting in the device having a sideways or upside down configuration. Moreover, since each unit is interconnected together and cannot rotate independently from its neighboring unit, roll over of one unit effectively results in multiple units, or the entire wall, being rolled over as well.

The British Petroleum disaster in the Gulf of Mexico highlighted another shortcoming related to a quick containment response. In the very beginning of the disaster, obtaining enough oil booms to properly contain such a large spill was problematic; as either the materials were stored in locations too remote from the accident site to be immediately effective, or production of new booms was too slow as it took time for the factories to produce the large amount of material. Once the disaster had been cleaned up, any amount of unused materials that was produced requires costly storage and transporting options, and may not be helpful should a similar disaster occur in another area.

Therefore, what is needed in the art is an improved containment device that 1) resists roll over when placed in an aquatic environment, 2) maintains its original conformation should roll over occur, thereby minimizing any reduction in containment capability when placed in rough or stormy seas, 3) attaches to other units to form a variable-length barrier wall system, and 4) provides units within the system that are interconnected in a way which permits rotation independently from adjacent units, thereby maintaining positional integrity of the entire system even if one of the units succumbs to roll over.

SUMMARY OF THE INVENTION

The instant invention describes a multi-purpose rotational barrier unit and a system of interconnected barrier units which function in multiple environments, including aquatic environments and land-based environments. In an aquatic environment, the multi-purpose rotational barrier unit is constructed and arranged to provide containment of a material, such as oil, floating within oceans, seas, inlets, or lakes. The instant invention provides a device which has a design configuration which provides hydro-dynamic stability in strong currents and high waves. The device is designed to roll over but maintain its original configuration in the rolled over state, thus reducing the amount of spill escaping the contained area. The instant invention also provides for a device which, when connected to other barrier units to form a large wall system, can rotate in rough seas independently from either adjacent barrier units or units indirectly attached as part of the overall system but positioned some distance away. The advantage of the instant invention, therefore, is that it is designed to perform containment at a location that may include rough surf or sea conditions. As a result, each of the individual units are able to move independently of adjacent units during surges which result in horizontal motion, heaves as a result of vertical motion, and roll-over or twisting about the horizontal axis. When not needed in an aquatic environment, the multi-purpose rotational barrier unit can be used in roadways or construction sites to prevent two objects, whether it is automobiles or people, from interacting.

In an illustrated example of the instant invention, the multi-purpose rotational barrier unit comprises a plurality of equally dimensioned walls interconnected to form side walls and a bottom wall. Connected to the side walls and the bottom wall are two opposing end walls which define a hollow interior portion. The opposing end walls contain one or more rotation members for providing rotational movement around a center axis when connected to one or both opposing side walls with an identical barrier unit. The rotation members are constructed and arranged to provide the barrier unit rotational movement which is independent from the movement of other barrier units directly attached to its opposing walls or units which may indirectly be attached as part of a larger barrier wall system. When placed in an aquatic environment, the interior portion of the device is constructed to provide ballast support and help maintain the unit in an upright position. The device contains optional attachments for providing enhanced functionality, such as the inclusion of a material absorbing structure assembly for providing limited absorbing capabilities, and netting located at various positions along or in between the devices for enhanced containment. When not in use in an aquatic environment, the barrier device can be used in construction sites or along roadways to protect workers or pedestrians from dangerous encounters.

An alternative embodiment of the instant invention includes three equally dimensioned walls. The walls interconnect to form two side walls and one bottom wall, thus forming a generally triangular shape having a first top edge and two side edges. Each of the equally sized walls contains one or more longitudinally segmented surfaces. Two opposing end walls are connected to the equally sized walls, thus forming a hollow interior which is constructed and arranged to act as a ballast to reduce the barrier unit from roll-over as a result of rough waves, strong winds, or stormy weather. When in non-aquatic environments, the hollow interior can act to stabilize and provide support for the device. Each of the opposing end walls contains one or more rotation members for providing rotational movement around a center axis when connected on one or both ends with an identical barrier unit. The rotation members are constructed and arranged to provide the barrier unit with rotational movement which is independent from the movement of the directly attached barrier units, or indirectly attached barriers connected as part of a larger barrier wall system. Particularly in an aquatic environment, rotation of the barrier about the center axis point results in the barrier maintaining its structural configuration in an upright position. The device contains optional attachments for providing enhanced functions, such as the inclusion of a material absorbing structure assembly for providing limited absorbing capabilities, and netting located at various positions along or in between adjacent devices for enhanced containment. When not in use in an aquatic environment, the barrier device can be used in construction sites or along roadways to protect workers or pedestrians from dangerous encounters.

Accordingly, it is an objective of the instant invention to provide a multi-use rotational barrier unit.

It is a further objective of the instant invention to provide a multi-use rotational barrier unit which is constructed and arranged to contain material floating within an aquatic environment.

It is yet another objective of the instant invention to provide a multi-use rotational barrier unit which is constructed and arranged to contain oil floating on the surface of the sea.

It is a still further objective of the invention to provide a multi-use rotational barrier unit constructed and arranged to provide a barrier unit which is hydro-dynamically stable in an aquatic environment having strong currents and high waves.

It is a further objective of the instant invention to provide a multi-use barrier which, in an aquatic environment, is constructed and arranged to roll over as a result of a wave or wind action, but maintain its original configuration in the rolled over state, thereby minimizing the amount of material from traveling to the opposite side of the unit.

It is a still further objective of the instant invention to provide a multi-use barrier which, in an aquatic environment, can be anchored 100+ yards off shore in lieu of on shore use of conventional inflatable oil containment booms.

It is yet another objective of the instant invention to provide a multi-use barrier which contains a rotating member constructed and arranged to provide the barrier unit with rotational movement which is independent from the movement of adjacently attached barrier units.

It is a still further objective of the instant invention to provide a multi-use barrier which contains a rotating member constructed and arranged to provide the barrier unit with rotational movement which is independent from the movement of indirectly attached units.

It is a further objective of the instant invention to provide a multi-use barrier which contains a rotating member constructed and arranged to provide rotational movement about a center axis point.

It is a still further objective of the instant invention to provide a multi-use barrier which contains a rotating member constructed and arranged to provide rotational movement about a center axis point using a polyaxial joint.

It is yet another objective of the instant invention to provide a multi-use rotational barrier unit which contains one or more attachment devices.

It is a further objective of the instant invention to provide a multi-use rotational barrier unit which has oil absorbing capability.

It is yet another objective of the instant invention to provide a multi-use barrier unit which contains one or more containment devices attached to the sides, top, bottom, or combinations thereof.

It is a still further objective of the instant invention to provide a multi-use rotational barrier unit which is constructed and arranged to interconnect to additional barrier units, thereby forming a larger barrier wall system.

It is a still further objective of the instant invention to provide a multi-use rotational barrier unit which is constructed and arranged to interconnect to additional barrier units, thereby forming a larger barrier wall system, in which oil absorbent or oil containment devices are positioned between the barrier units.

It is a further objective of the instant invention to provide a multi-use rotational barrier unit which is constructed and arranged to interconnect to additional barrier units, thereby forming a larger barrier wall system in which oil absorbent or oil containment devices positioned between the barrier units can rotate independently from the barrier unit.

It is yet another objective of the instant invention to provide a multi-use rotational barrier unit which is constructed and arranged to be placed along a roadway or construction site to protect workers and/or pedestrians when not being used in an aquatic setting.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
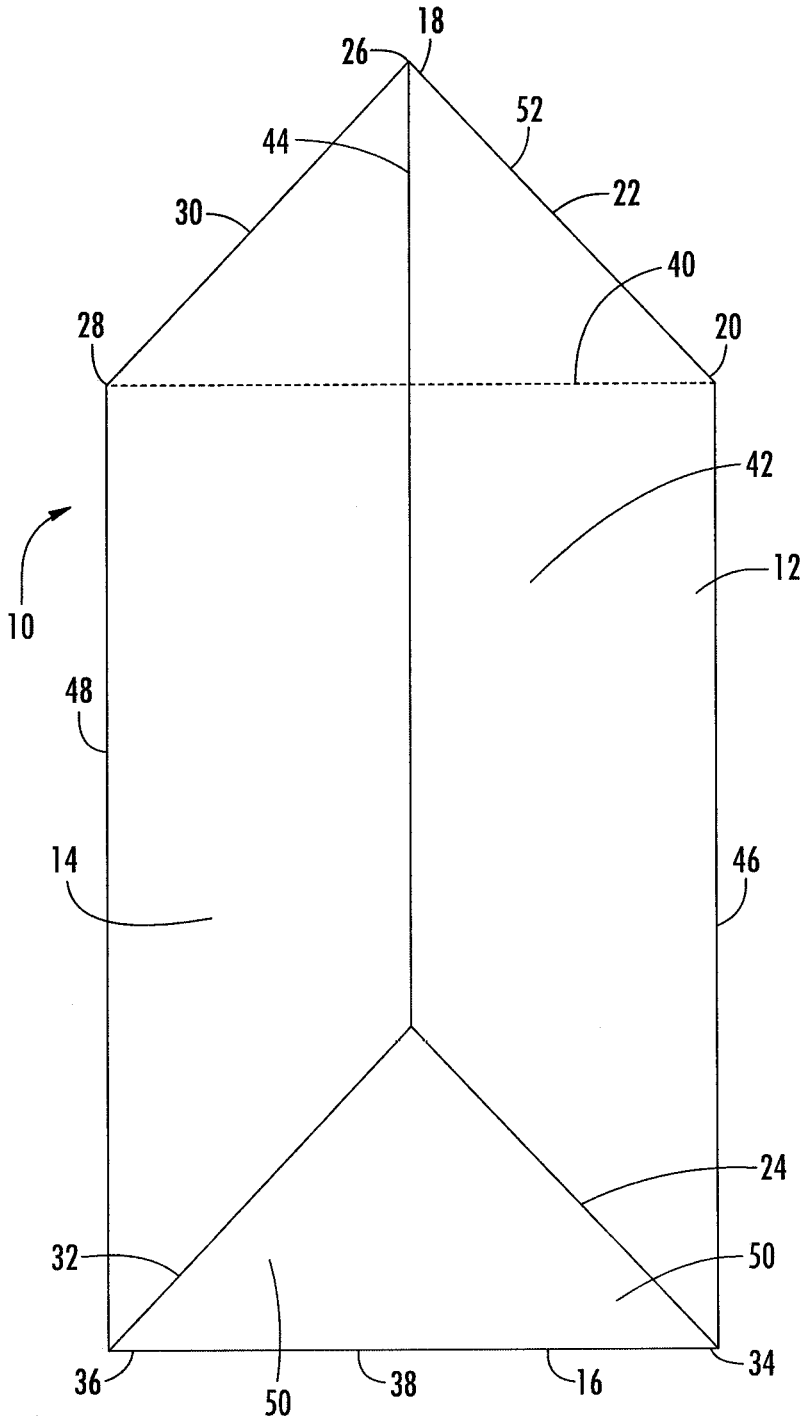
FIG. 1 is a top perspective view of an illustrative embodiment of the multi-purpose rotational barrier unit of the instant invention.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

With reference to FIGS. 1-7, an illustrative embodiment of the multi-purpose rotational barrier unit is shown and indicated by the number 10. The multi-purpose rotational barrier unit 10 can be made from various materials, such as low density polyethylene, high density polyethylene, heavy duty polyethylene, high impact styrene, polycarbonates, or similar material known to one of skill in the art. In a preferred embodiment, the multi-purpose rotational barrier unit 10 is integrally molded polyethylene, manufactured in one piece. The multi-purpose rotational barrier unit 10, however, can be constructed using other techniques known to one of skill in the art, including rotational molding or blow molding techniques, and may be constructed of several individual components and connected together. To increase longevity, the barrier unit 10 may also include or be constructed of materials which make the device resistant to the weather, leaching, and biodegradation, and retain their mechanical and chemical properties under low and/or high temperatures. Use of ultraviolet light inhibitors may be used to provide the barrier unit 10 with further protection from weather conditions. The barrier material may also be constructed of or coated with materials which contain fire retardant properties.

The multi-purpose rotational barrier unit 10 comprises three (3) equally sized walls, side walls 12 and 14 and bottom wall 16. The bottom wall 16 forms the floor of the multi-purpose rotational barrier unit. The side wall 12 contains a first end 18, a second end 20, and two opposing edges 22 and 24 extending between the first end 18 and the second end 20. The side wall 14 contains a first end 26, a second end 28 and two opposing edges 30 and 32 extending therebetween. The bottom wall 16 contains a first end 34, a second end 36, and two opposing edges 38 and 40 extending therebetween. The distance between the opposing edges, for example between 22 and 24, or 30 and 32, defines the length of the multi-purpose rotational barrier unit 10 and can be designed in variable distances, including, but not limited to, 6 feet, 8 feet, 10 feet, 12 feet or 20 feet. The walls 12, 14, and 16 are interconnected, thus forming the exterior surface 42 of the multi-purpose rotational barrier unit 10. The side wall 12 connects to the side wall 14 to form edge 44 and with bottom wall 16 to form edge 46. The sidewall 14 connects to the bottom wall 16 to form an edge 48. One or more of the longitudinal edges 44, 46, and 48, although illustrated in a pointed manner may contain an additional angled surface to provide a partially flat surfaced edge. The distance between the edges, such as 44 and 48 or 44 and 46, defines the side length of the multi-purpose rotational barrier unit 10 and could be constructed to various, non-limiting sizes, including 32 inches, 42 inches, 48 inches, and 54 inches. A pair of opposing end walls 50 and 52 interconnects with the side walls 12, 14, and bottom wall 16, thereby forming an inner hollow interior 54, see FIG. 4. As an optional feature, the multi-purpose barrier unit 10 may include end lips 55, see FIG. 3. The end lips 55 are made of an integrally molded polyethylene material and are preferably located at both ends of the barrier unit, i.e. part of the opposing walls 50 or 52.

Each of the walls is constructed of a thickness to accommodate a material which may act as ballast for sea applications, or to prevent or limit movement should the device be placed on land, such as along a roadway or construction site. Given the enclosed nature of the hollow interior 54, the multi-purpose rotational barrier unit 10 is constructed to house a material therein. While the preferred material is a liquid such as water, the device may also accommodate solid materials such as sand or salt. The type of material and amount placed within depends on the intended environment of use. To aid the user in filling the hollow interior 54 with water, a filling access aperture 56 is placed along a portion of the multi-purpose rotational barrier unit 10. The filling access aperture 56 is illustrated along the top portion of a side wall in FIG. 2B, however, aperture 56 can be placed anywhere on the multi-purpose rotational barrier unit 10. While a preferable shape is illustrated as rounded having a diameter of 4 inches, the diameter size as well as the aperture shape can be varied depending on the needs of the user. The filling access aperture 56 is constructed and arranged to interconnect with a fill plug 58. The fill plug can be made of any material and is designed to seal the filling access aperture 56 through any means known to one of skill in the art, including a screw type or plug/snap type fitting. In a preferred, albeit non-limiting embodiment, the device contains a 4 inch diameter PVC plastic screw type fitting fill plug 58 having a rubber, plastic or neoprene "O" ring to seal and prevent leaks. The fill plug 58 serves the dual purpose of keeping the filled liquid within the hollow interior 54 as well as preventing other materials, such as dirt, debris, or water, from entering within once the desired amount of liquid to be filled within has been reached. By keeping outside materials from entering the interior 54, the risk of the multi-purpose rotational barrier unit 10 becoming too heavy and decreasing the effectiveness of the device is minimized. The multi-purpose rotational barrier unit 10 may contain one or more slit openings 57 to allow air to pass through the barrier thereby preventing the barrier from roll-over during periods of high winds or stormy weather. The multi-purpose rotational barrier unit 10 may contain one or more slots to allow thongs to easily pass through for lifting the units by a fork lift. The slots also allow for water to pass under the barrier for drainage at roadway/construction sites applications.

Along the side wall 12 or 14 is a variable sized and shaped drainage aperture 60 constructed and arranged to interconnect with a drainage plug 62. Similar to the fill plug 58, the drainage plug 62 can be made of any material and is designed to seal the drainage aperture 60 through any means known to one of skill in the art, including screw type, plug or snap type fitting. In a preferred, albeit non-limiting embodiment, the device contains a 2 inch diameter PVC plastic screw type fitting drainage plug 62 having a rubber, plastic or neoprene "O" ring to seal and prevent leaks.

Figure 5:
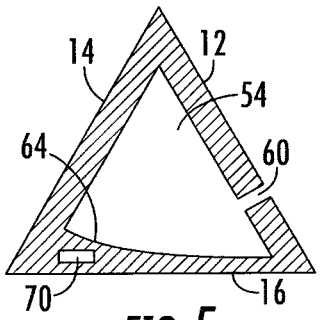
FIG. 5 is a cross sectional view of the multi-purpose rotational barrier unit of the instant invention as illustrated in FIG. 1, showing the sloping portions of the bottom wall towards an edge.
Figure 6:
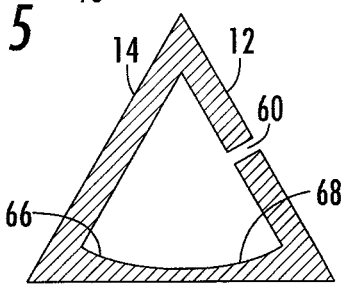
FIG. 6 is a cross sectional view of the multi-purpose rotational barrier unit of the instant invention as illustrated in FIG. 1, showing multiple sloping portions of the bottom wall.

To aid in the drainage of the liquid filled within, the multi-purpose rotational barrier unit 10 may optionally be constructed to contain walls which include one or more sloping portions. Referring to FIGS. 5 and 6, a preferred embodiment includes the bottom wall 16 which contains variable thickness to provide sloping, or curvature, 64. The bottom wall 16 could be constructed to contain a continuous slope downward from the one end to the other end, i.e. from end adjacent side wall 14 to the end adjacent side wall 12, see FIG. 5. The sloping portion terminates at or near the drainage aperture 60. The bottom wall 16 may be constructed to contain a plurality of sloping portions 66 and 68 directed toward the center, see FIG. 6. In this configuration, the sloping portions 66 and 68 terminate at the drainage aperture 60 which is positioned at or near the center bottom of the bottom side wall 12 or 14. Alternatively, the bottom wall 16 could be constructed to contain either one longitudinal continuous slope downward from end 38 to its opposing end 40 or a plurality of sloping sections terminating in a centrally located drainage aperture (not illustrated). Embedded within the bottom wall 16 is one or more weighted objects 70. While such feature is optional, the one or more weighted objects 70 are of sufficient size and weight and placed at various positions along the length of bottom wall 16 to provide adequate ballast for sea applications to help maintain the barrier in the upright position. In land based applications, weighted objects 70 prevent or minimize vertical and/or horizontal movement.

Figure 7:
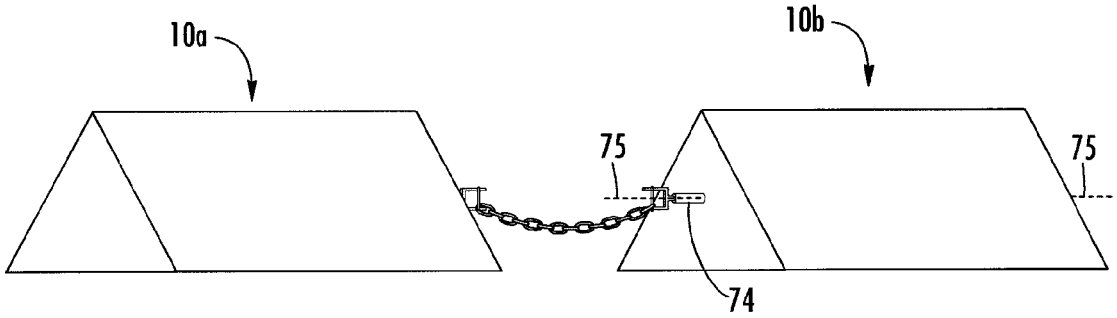
FIG. 7 is a side perspective view of two multi-purpose tri-rotational barrier units of the instant invention interconnected together.
Figure 8A:
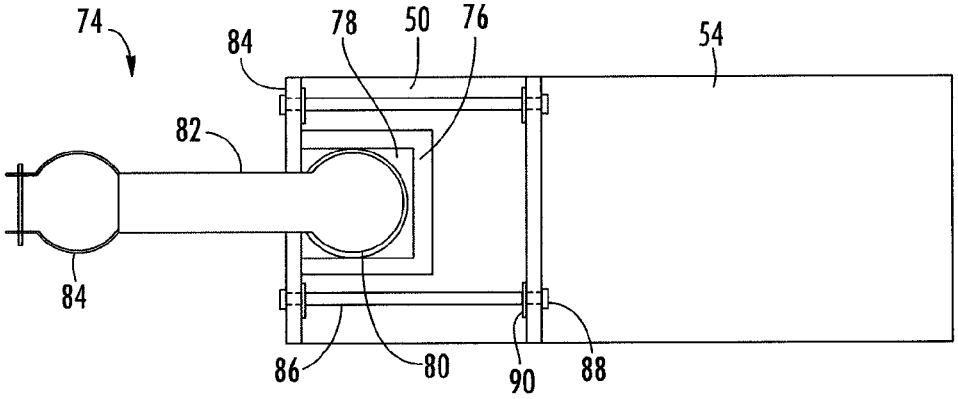
FIG. 8A is a longitudinal cross sectional view of the multi-purpose rotational barrier unit of the instant invention as illustrated in FIG. 1, showing the ball and socket assembly.
Figure 8B:
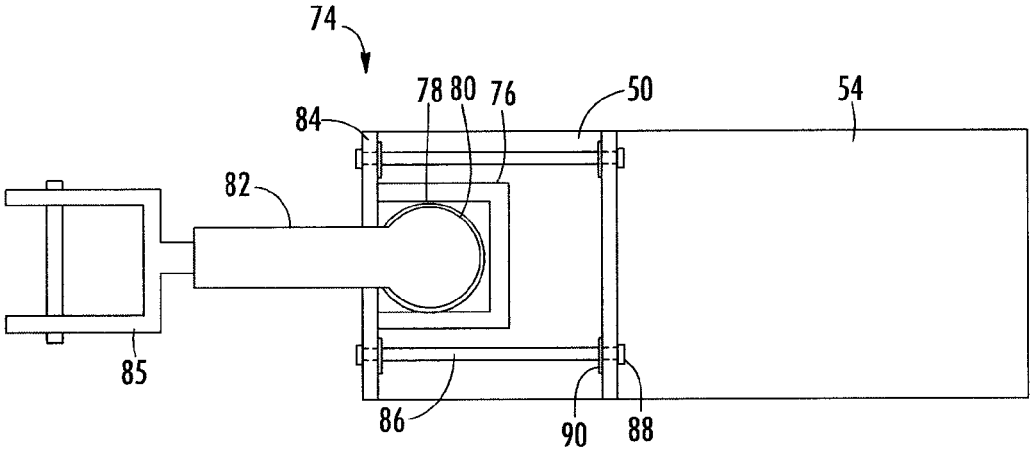
FIG. 8B is a longitudinal cross sectional view of the multi-purpose rotational barrier unit of the instant invention as illustrated in FIG. 1, showing a clevis with pin attachment at the end of the ball and socket assembly.

While a single multi-purpose rotational barrier unit 10 can be used to divide a particular area, one of the advantages of the instant invention rests in the fact that two or more multi-purpose rotational barrier units 10A and 10B can be interconnected to form an extended length barrier system, see FIG. 7. In FIGS. 8A and 8B, a rotating member, illustrated herein as a polyaxial joint, such as ball and socket assembly 74, aids in connecting the ends of a first multi-purpose rotational barrier unit 10A to a second multi-purpose rotational barrier unit 10B. The rotation members are preferably located on each of the opposing end walls 50 and 52 and are constructed and arranged to provide the first multi-purpose rotational barrier unit 10A angular or rotational motion about its center axis which is independent from the movement of the adjacently connected second multi-purpose rotational barrier unit 10B. As a result of the rotating member, rotation of the barrier about the center axis results in a barrier maintaining its structural configuration in the upright position. In an aquatic environment, the initial starting point includes a portion of the bottom wall 16 resting at or below the water level with all or a portion of the side walls 12 and 14 extending above the water level, preferably at a distance of between 15 inches and 2.5 feet above the surface water. This distance is dependent upon the size of the barrier unit in use. As the water environment becomes rough and the barrier gets pounded by wave actions, the barrier may eventually roll over. As a result of the roll over, one of the side walls enters below the water surface and becomes the new bottom wall. Because the original bottom wall has the same shape and dimensions as the other walls, it now assumes the position of a side wall. As a result, the original structural configuration is maintained and the device remains in an upright position.

In a preferred embodiment, the ball and socket assembly 74 is embedded into and fastened to the multi-purpose rotational barrier unit 10 at its center axis 75. Referring to FIG. 8A, the ball and socket assembly 74, which is preferably embedded into opposing end walls or if utilized within the end lips, includes a seating member 76 containing a partially, spherically-shaped socket 78. The spherically shaped socket 78 is constructed and arranged to receive a spherical head portion 80 of a rod 82. The spherical head portion 80 may be secured to the spherical socket 78 by one or more apertured plates 84 which secure to seating member 76 by fastening members such as a galvanized hex bolt 86 and nuts 88, and neoprene washers 90 to prevent leaking. The ball and socket assembly 74 is preferably made of materials which resist corrosion, including but not limited to stainless steel or galvanized materials. Welded to, or attached to by other mechanisms known to one of skill in the art, the opposite end of the spherical head portion 80 of rod 82 is a second connecting member, illustrated herein as an anchor shackle 84, FIG. 8A, or clevis with pin, 85, see FIG. 8B. The clevis with pin 85 may also be designed to provide independent rotation from the rotation of the rod 82 through use of an articulating clevis fastener, see embodiment sold by Midwest Control Products, Bushnell, Ill., and described in U.S Patent Application Publication 2008/0240848. In this manner, anything connected to the articulating clevis may rotate independent from the rotation generated by the ball and socket assembly. While the ball and socket assembly 74 is an illustrative example, the instant invention can include the use of one or a combination of other connecting elements, including eye hook plates, screws, bolts, clips, adhesives, staples, and/or other types of joints or fasteners.

Figure 2A:
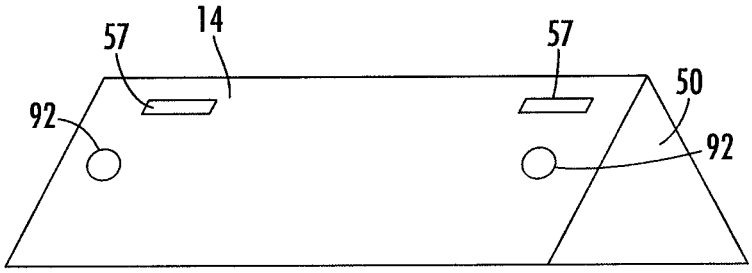
FIG. 2A is a right side perspective view of the multi-purpose rotational barrier unit of the instant invention as illustrated in FIG. 1.
Figure 3:
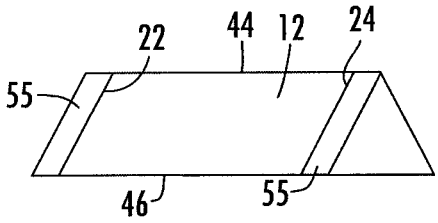
FIG. 3 is a side perspective view of the multi-purpose rotational barrier unit of the instant invention as illustrated in FIG. 1, showing a solid integrally molded polyethylene end lip in a triangular shape at each end of the multi-purpose rotational barrier unit.
Figure 2B:
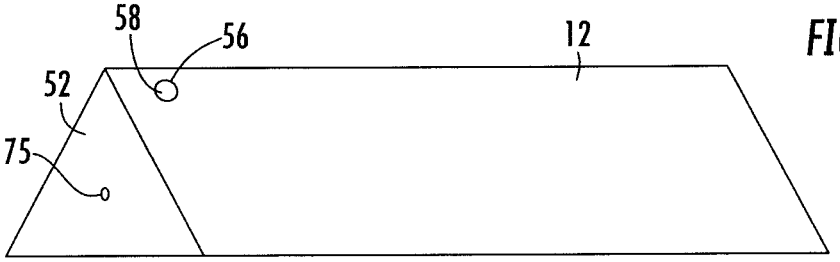
FIG. 2B is a left side perspective view of the multi-purpose rotational barrier unit of the instant invention as illustrated in FIG. 1.
Figure 4:
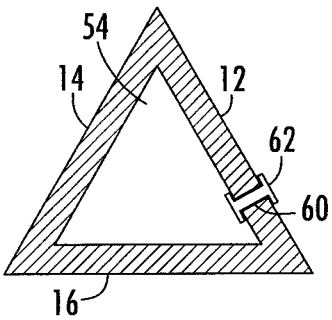
FIG. 4 is a cross sectional view of the multi-purpose rotational barrier unit of the instant invention as illustrated in FIG. 1.

Each of the side walls 12 and 14 may optionally include an access panel 92, FIG. 2A, preferably located at each side end. The access panel 92 may be an opening of a size sufficient to allow tools, materials, or a human hand entry should the ball and socket assembly 74 need adjustment or repairs. An access panel plug or cap, such as a screw or push in type, may be inserted within the access panel opening, to prevent unwanted material from contacting the ball and socket assembly. In a preferred embodiment, the access panel plug or cap is a screw plastic screw type plug containing rubber, plastic, or neoprene "O" rings to seal and prevent leaks.

Figure 9A:
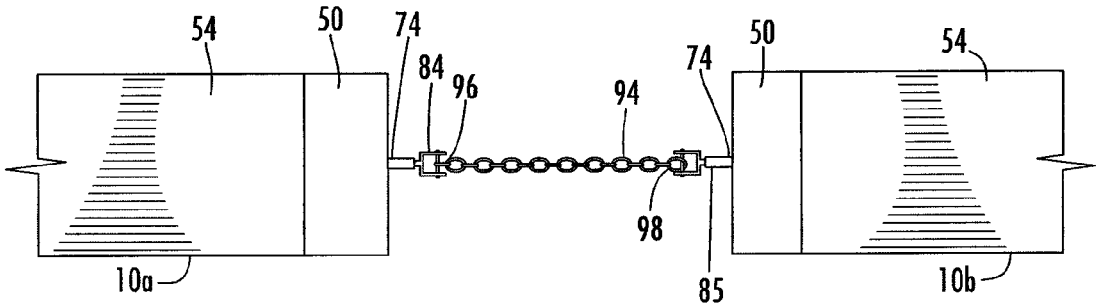
FIG. 9A is a cross sectional view of two multi-purpose rotational barrier units attached by a linking member.

Referring to FIG. 9A, a linking member, illustrated herein as a linked chain 94, is used to connect a first multi-purpose rotational barrier unit 10A to a second multi-purpose rotational barrier unit 10B. The linked chain 94 is constructed of various materials, including but not limited to, corrosive resistant plastics, zinc coated materials, galvanized materials, or stainless steel, and attaches to the ball and socket assembly 74 positioned along the center axis 75 of the first multi-purpose rotational barrier unit 10A. The linked chain 94 is illustrative of a preferred embodiment of a linking member. Use of a chain is not to be perceived as a limiting example, as the linking member could be a rope, bungee chord, cable, wire, rubber band, or the like. A first end 96 of the linked chain 94 attaches to the ball and socket assembly 74 positioned at the center axis point of the first multi-purpose rotational barrier unit 10A through the use of the shackle 84, articulated clevis 85, or the like. The opposing end 98 of the linked chain 94 attaches to the ball and socket assembly 74 of the second multi-purpose rotational barrier unit 10B positioned at the center axis point 75 through the use of an anchor shackle, articulated clevis, or the like 98. Connections at the center axis provide each of the tri-rotational barrier units to rotate freely and independently from each other. The linked chain 94 is variably sized, can be constructed of various lengths, and has a rated capacity sufficient to carry its intended loads.

Figure 9B:
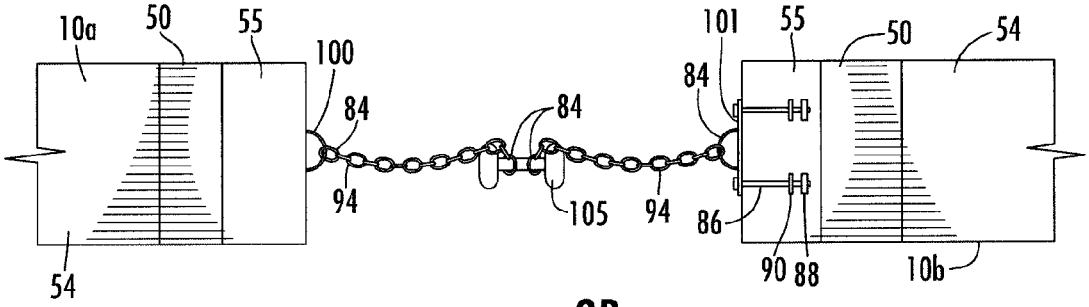
FIG. 9B is a cross sectional view of two multi-purpose rotational barrier units linked together in an alternative manner as that illustrated in FIG. 9A.

FIG. 9B illustrates two multi-purpose rotational barrier units, 10A and 10B, linked together in an alternative manner as that illustrated in FIG. 9A. Multiple linked chains attach to the integrally molded polyethylene end lip 55 of the multi-purpose rotational barrier units, 10A and 10B through looped hook 100 or through a looped hook 100 secured to a looped hook plate 101 and shackle 84. The looped hook plate 101 is secured to the integrally molded polyethylene end lip 55 via hex bolts 86, nuts 88, and washers 90. The opposite ends of both of the linked chains 94 attach to second shackles 84. Shackles 84 secure to a dumbbell shaped member 105. Each linked chain, therefore, can rotate independent from each other. Should the multi-purpose rotational barrier unit 10A rotate causing its chain to rotate as well, the multi-purpose rotational barrier unit 10B, and its link chain, are maintained in an upright position and will not rotate as result of the rotation generated by barrier unit 10A.

Figure 10A:
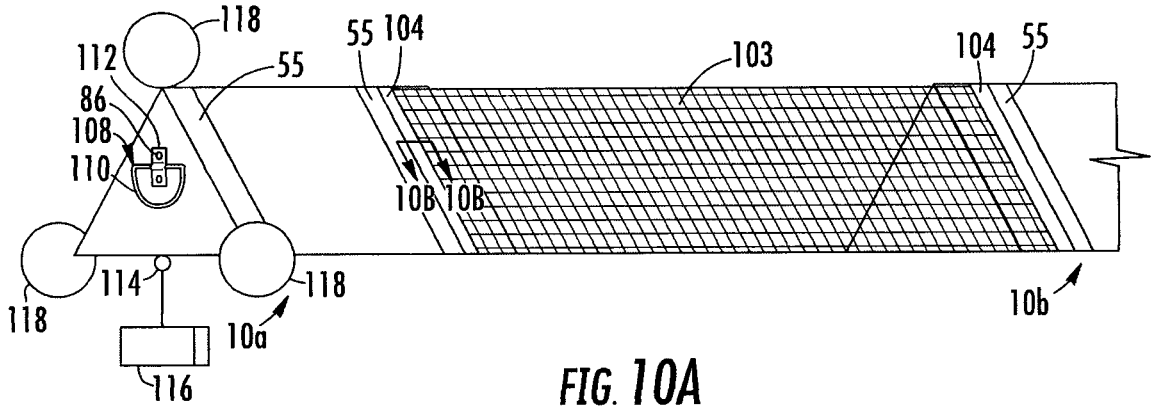
FIG. 10A is a side perspective view of two multi-purpose rotational barrier units of the instant invention, illustrating various attachment devices and use of a recessed channel slot for connecting two barrier units together and/or netting.
Figure 10B:
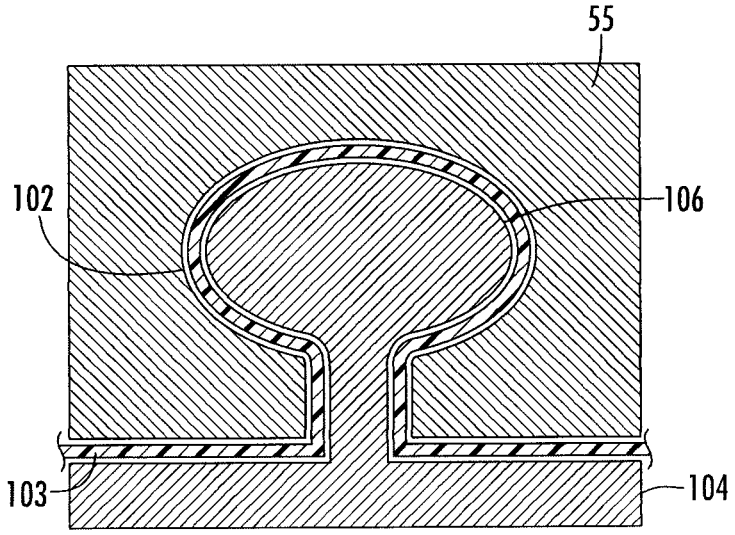
FIG. 10B is a cross sectional view taken along lines 10B-10B of FIG. 10A.

Referring to FIGS. 10A and 10B, the multi-purpose rotational barrier unit 10A may optionally include a continuous recessed channel slot 102, for securing a plastic fabric netting material 103 between the multi-purpose rotational barrier unit 10A and the second multi-purpose rotational barrier unit 10B. Such connection may be particularly useful in calm aquatic environments, such as a lake. The continuous recessed channel slot 102 is sized and shaped to receive a plate 104 having a continuous spherical shaped rod 106. For illustrative purposes, the continuous recessed channel slot 102 is shown positioned within the end lip 55. However, the continuous recessed channel slot 102 may be positioned along any of the walls 12, 14 or 16. Attachment of adjacent barrier units in this manner, therefore, provides a connection in which rotation of each unit is dependent upon the rotation of the connected unit and may be useful in locations which do not require all units to rotate independently of other units. Although not illustrated, the multi-purpose rotational barrier units 10A may contain other means for attaching to a second barrier unit known to one of skill in the art without departing from the spirit of the invention. For example, the barrier units may include dumb bell shaped deformations (not illustrated) positioned at the top and at each end of the barrier units. The dumb bell shaped deformations can be sized and shaped to accommodate a separate heavy PVC plastic dumb bell attachment device. The devices can be used to connect barriers together for roadside/construction site applications. Additionally, two devices may simply be attached using an eye hook plate and an anchor shackle.

The multi-purpose rotational barrier unit 10 contains one or more lifting hook assembly 108, illustrated herein as a looped object 110 secured to plate 112, see FIG. 10A. The lifting hook assembly 108 can be secured to any portion of the multi-purpose rotational barrier unit 10, but is preferably secured to one or both of the opposing end walls 50 and 52, at or near edge 44 through fastening means common to one of skill in the art, such as bolts 86 or screws. The lifting hook assembly 108 is constructed to provide a mechanism for the lifting or pulling of the multi-purpose rotational barrier unit 10 onto transportation means, such as trucks, barges, or boats, for transfer of the units to various sites. The rated capacity of the lifting hook assembly 108 can be varied and depend upon the size and length of the barrier being lifted or pulled. A rated capacity of approximately 11,000 pounds, however, should be sufficient to handle a barrier which is fully filled with water. While the hook is illustrated as generally triangular in shape, such shape is not limiting and could contain other curved shapes as well. The lifting hook assembly 108 can be made of any material, including, but not limited to, zinc plated, galvanized, or stainless steel materials.

One or more second connecting members, illustrated herein as eye hooks 114, are embedded into or are surface mounted to various points along the multi-purpose rotational barrier units 10. Where multiple eye hooks 114 are used, they are preferably spaced at various intervals and of adequate on center spacing to allow for attachments of various enhanced features, to be described later. The eye hooks 114 can be integrally molded within the multi-purpose rotational barrier units 10 during the manufacturing process or they can be surface mounted using bolts or screws. The eye hooks 114 can be made from various plastic materials, or metal fabrications, such as zinc coated or galvanized or stainless steel materials. Each of the eye hooks can be varied in size and are constructed to the rated capacity of the anticipated loads they are designed to carry.

Several additional features are optionally included as part of the multi-purpose rotational barrier unit 10. In addition to filling the multi-purpose rotational barrier unit 10 with water, one or more weighted objects 116 can be attached to one or more portions of the multi-purpose rotational barrier unit 10, preferably to the bottom center. Each of the weighted objects 116 are attached to the multi-purpose rotational barrier unit 10 using the eye hooks 114, anchor shackles 84, or combinations thereof, or other fastening means known to one of skill in the art. The weighted objects are not limited to a particular size, shape, or weight limit. The weighted objects 116 are designed to 1) provide proper ballast for the variously sized multi-purpose rotational barrier units 10, and 2) to right the multi-purpose rotational barrier units 10 should the barrier unit be rolled as a result of a wave action. In this manner, therefore, the weights are designed to prevent the units from being turned upside down as a result of rough aquatic environments. Although the weighted objects 116 are preferably made of iron, other non-limiting materials, such as plastics, rubber, steel, or lead may also be used without departing from the spirit of the invention.

One or more flotation device, illustrated herein as flexible, inflatable balloons or foam balls 118 are attached to the multi-purpose rotational barrier unit 10 to provide each of the barrier units with flotation. While such flotation devices 118 are optional, inclusion of such devices further provides the multi-purpose rotational barrier unit 10 with additional means to resist roll over during transportation or heavy wave action while at the intended site. In addition to, or in place of the inflatable balloons or foam balls, commercially available oil booms or hair net booms may be attached to the multi-purpose rotational barrier unit 10 to provide additional enhanced oil absorbent/containment capabilities. Attachment of one or more flotation devices 118 is preferably at or near the opposing ends 50 and 52, at or near end lip 55, and/or along one or more of the three walls 12, 14 and 16. The one or more flotation devices 118 may also be positioned between two interconnected multi-purpose rotational barrier units 10. Connection to the multi-purpose rotational barrier unit 10 is accomplished using the eye hooks 114, the linked chains 94, ropes, or other fastening mechanisms such as industrial grade plastic ties.

While the multi-purpose rotational barrier unit 10 functions primarily as a barrier, separating one area from another, attachment of variously sized absorbent nets, illustrated herein as an oil absorbent net 120 (see FIG. 11A), allows the multi-purpose rotational barrier unit 10 to function both as an oil containment barrier and a limited oil absorbing device. The oil absorbent net could be constructed in the form of but not limited to: interwoven oil absorbing fibers, or hair net, such as cotton or polypropylene, one or more oil absorbent pads, or a polypropylene filled sock enclosed within a mesh outer sleeve. The oil absorbent net could also be in the form of a silt fence or oil absorbent material connected to stretchable plastic netting. In any form, the oil absorbent net 120 attaches to the top of, or at the sides of the multi-purpose rotational barrier unit using the eye hooks 114, the linked chains 94, or a continuous channel strut (not illustrated) to provide a leak proof attachment, or other fastening mechanisms such as industrial grade plastic ties. While the netting is illustrated as being capable of absorbing oil, such netting can be modified to absorb other contaminants, such as chemicals, or waste, or debris.

Figure 11A:
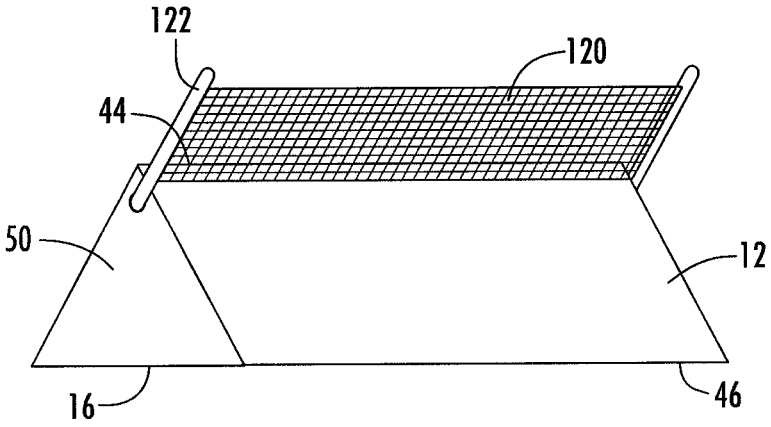
FIG. 11A is a side perspective view of the multi-purpose rotational barrier unit of the instant invention as illustrated in FIG. 1, showing a netting attachment along the top edge.
Figure 11B:
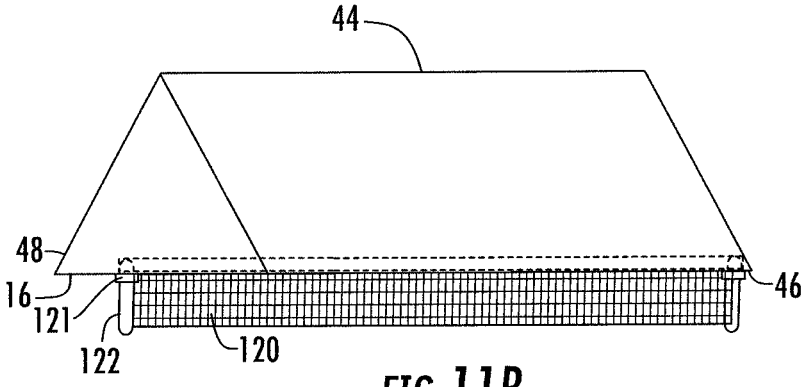
FIG. 11B is a side perspective view of the multi-purpose rotational barrier unit of the instant invention as illustrated in FIG. 1, showing a netting attachment along the center of the bottom wall.
Figure 11C:
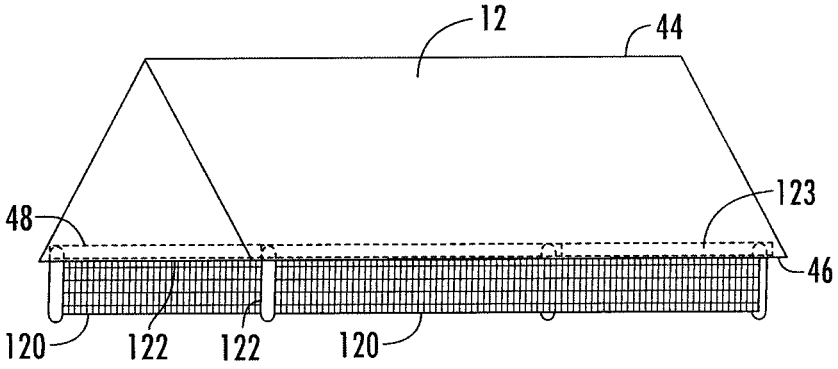
FIG. 11C is a side perspective view of the multi-purpose rotational barrier unit of the instant invention as illustrated in FIG. 1, showing multiple netting attachments to the side bottom edges.

In addition to the netting 120 being positioned between barrier units 10A and 10B, the netting 120 may be positioned above the barrier unit and/or below the barrier unit. Referring to FIGS. 11A-11C, the netting 120 is illustrated attached to a post 122. The post 122 attaches to a portion of the barrier using screws/bolts and extends above edge 44 (FIG. 11A). Referring to FIG. 11B, the post 122 with netting 120 is illustrated attached to the bottom contour of bottom wall 16 (FIG. 11B), preferably at the center, through a continuous channel strut 121. In this manner, netting 120 extends downward from the barrier unit 10 and provides barrier functionality below the units. Use of a post 122, however, is not necessary.

Because the device contains two side edges 46 and 48, one netting may be attached along edge 46 and/or a second netting may be attached along edge 48, see FIG. 11C. Attachment along one or both edges may be combined with attachment of netting 120 along the center of bottom wall 16.

Figure 12:
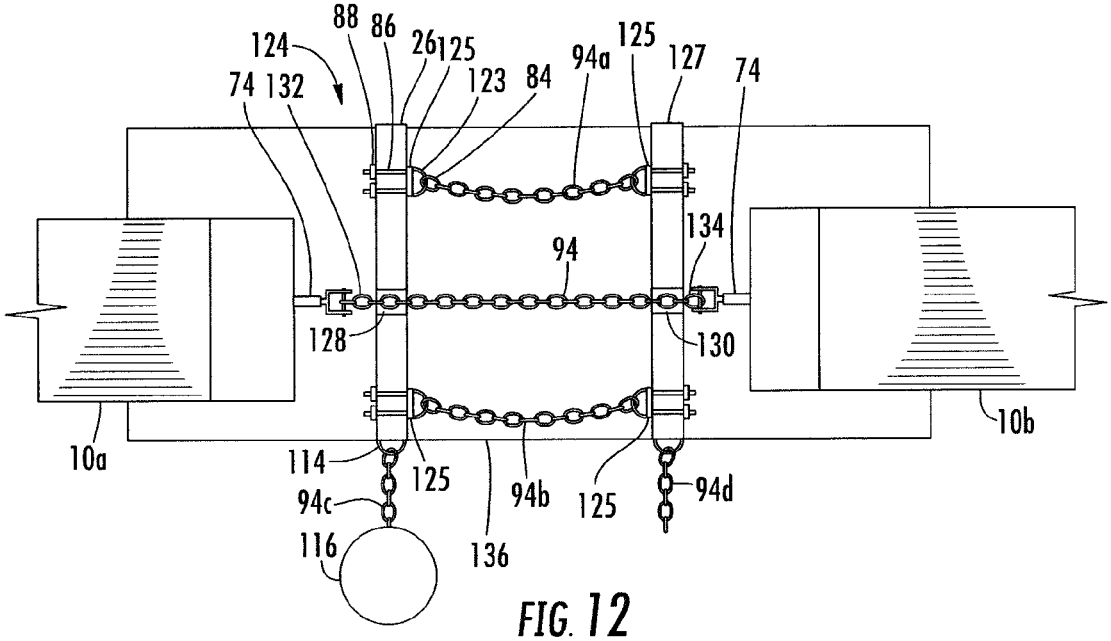
FIG. 12 is a longitudinal cross sectional view of two of the multi-purpose rotational barrier units connected through a material absorbent structure assembly.

In place of the absorbent net, a material absorbent structure assembly 124 can be utilized and preferably positioned between two multi-purpose rotational barrier units 10A and 10B, see FIG. 12, for absorbing materials, such as oil, as they pass in between two adjacently connected units. The material absorbent structure assembly 124, as illustrated herein, consists of two support structures illustrated as a first post 126 and a second post 127. Each of the posts 126 and 127 contain a linking member opening 128 and 130, respectively, which are sized to receive a linking member, illustrated herein as a linked chain 94. The linked chain 94 passes through the linking member openings 128 and 130 such that a first end 132 of the linked chain 94 connects to the ball and socket assembly 74 located on the multi-purpose rotational barrier units 10A while the opposing end 134 connects to the ball and socket assembly located on the multi-purpose rotational barrier units 10B. While neither of the posts 126 or 127 is directly connected to the multi-purpose rotational barrier units 10A or 10B, the posts connect indirectly to the multi-purpose rotational barrier units 10A or 10B at the ball and socket assembly via shackles or an articulated clevis. Connection in this manner allows either of the posts to freely swivel around the center axis point of each of the multi-purpose rotational barrier units 10A and 10B. The linked chain may also contain one or more hex bolts, nuts, shackles, or other fastener devices inserted within the chain (not illustrated) in order to prevent the posts from side to side sliding along the length of the chain, thereby keeping the posts properly orientated and spaced apart while the posts freely tilt and rotate around the center axis.

In addition to the main linked chain, two additional chains 94*a* and 94*b*, placed above and below the linked chain 94 may optionally be utilized. One end of the chains 94*a* and 94*b* attaches to post 126 through a connecting element illustrated as a shackle 84. The shackle 84 is attached to the hook member 123 of the eye plate 125 which is secured to the post through hex bolts 86, nuts 88, and washers (not illustrated). The opposite end of chains 94*a* and 94*b* attach to post 127 in the same manner. The size and shape of the fastening elements, such as the shackles or eye hook plates, are constructed of sufficient size to handle the desired load weights. Each of the posts 126 and 127 may optionally contain eye hooks 114 attached to the bottom part of the posts. The eye hook 114 allows additional attachments to be connected to the material absorbent structure assembly 124, such as an additional linked chain 94*c* attached to a weighted object 116, non-attached linked chain 94*d*, or anchor shackles (not illustrated). The attached weighted object 116 provides ballast for the material absorbent structure assembly 124. The material absorbent structure assembly is designed to be collapsible and rotatable, preferably independent of the barrier unit.

To prevent the flow of materials, such as oil slicks, in the water from passing from one side of the multi-purpose rotational barrier unit 10 to the other side, a reinforced plastic netting 136, such as safety or tree fencing, can also be attached to posts 126 and 127. The reinforced plastic netting 136 may also be designed to pass through the ball and socket assembly as well. Preferably, the reinforced plastic netting 136 is wrapped behind and around the sides of each of the posts and the ends of the netting are placed along the front (oil side) of the barriers. The reinforced plastic netting 136 can be designed with a plurality of openings to allow water to pass through but prevent, or limit, the passage of oil to the other side. The reinforced plastic netting 136 can be attached to the posts using any known mechanism known to one of skill in the art, including nail, staples, or industrial grade plastic ties. The reinforced plastic netting 136 may alternatively be constructed of a solid, stretchable plastic material with no openings (not illustrated). In either form, the reinforced plastic netting 136 may be used as a backup material for attaching such items as oil absorbing materials or silt fencing placed between the barriers.

Figure 13:
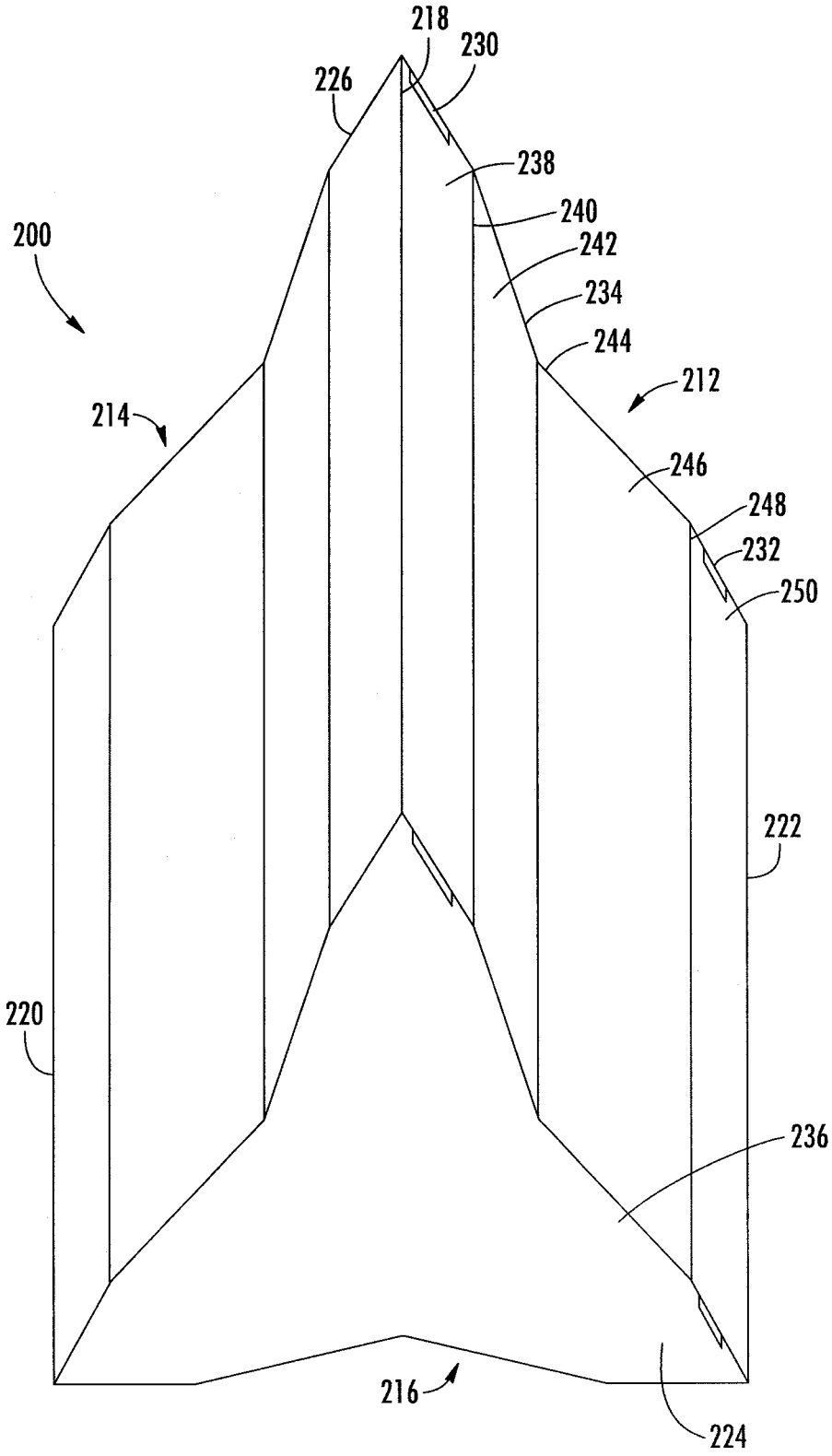
FIG. 13 is a top perspective view of an alternative embodiment of the multi-purpose rotational barrier unit of the instant invention.
Figure 14:
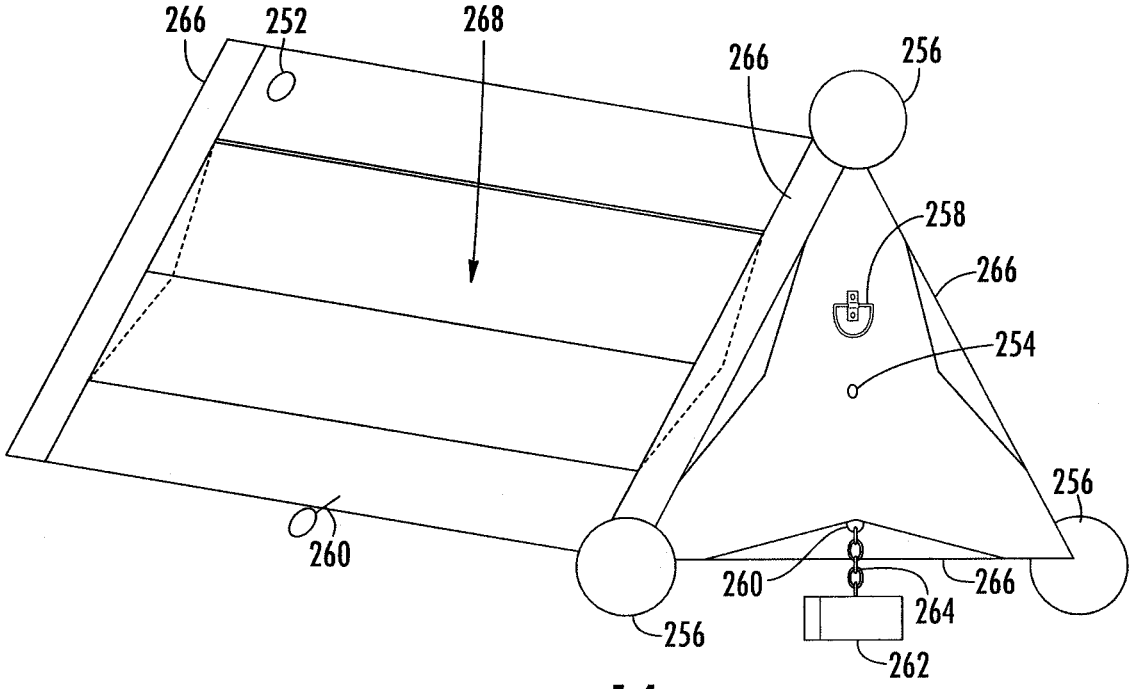
FIG. 14 is a right side perspective view of the alternative embodiment of the multi-purpose rotational barrier unit of the instant invention as illustrated in FIG. 13.
Figure 15:
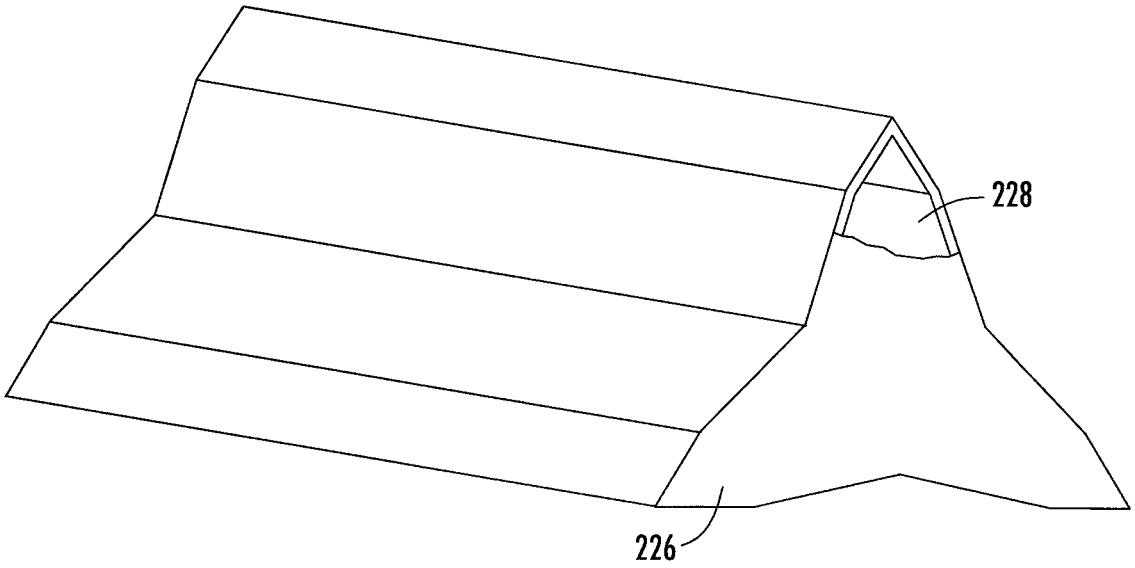
FIG. 15 is a left side perspective view of the alternative embodiment of the multi-purpose rotational barrier unit of the instant invention as illustrated in FIG. 13, with a partial cut away view illustrating the hollow interior.

Referring to FIGS. 13-15, an alternative embodiment of multi-purpose rotational barrier unit is shown and indicated by the number 200. The multi-purpose rotational barrier unit 200 is constructed and arranged to dissipate side impacting loads, such as those generated by rough water waves, in an upward direction to lessen translational forces on the unit, thereby decreasing the tendency of the unit to rotate or topple over. The multi-purpose rotational barrier unit 200 comprises multiple, equally sized walls, side walls 212 and 214, and bottom wall 216 which defines the floor of the barrier unit. The side wall 212 and the side wall 214 intersect to form a first longitudinal edge 218. The bottom wall 216 intersects with the side wall 214 to form a second longitudinal edge 220 and with side wall 212 to form a third longitudinal edge 222. One or more of the longitudinal edges 218, 220, and 222, although illustrated in a pointed manner, may contain an additional angled surface to provide a partially flat surfaced edge. The distance between the longitudinal edges, such as between edge 218 and edge 222, defines the side lengths, which are equally sized, of the multi-purpose rotational barrier unit 200. A pair of opposing end walls 224 and 226 interconnects with the side walls 212, 214, and bottom wall 216, thereby forming an inner hollow interior 228, see FIG. 15. Since each of the walls are identical in configuration, only the side wall 212 is described in detail herein, it being understood that the side wall 214 and the bottom wall 216 are formed with identical features. The side wall 212 contains a first end 230, a second end 232, and two opposing edges 234 and 236. The distance between the two opposing side walls 224 and 226 defines the length of the multi-purpose rotational barrier unit 200. While the general shape of each the multi-purpose rotational barrier unit 200 in cross section is generally triangular, the side wall 212 contains inwardly tapering and outwardly diverging portions relative to the edge 218 or 222, thereby forming a side wall with a plurality of edges and longitudinally extending segmented surfaces.

In the non-limiting example, the multi-purpose rotational barrier unit 200 contains four segmented longitudinal surfaces. The first longitudinally extending surface 238 diverges from edge 218 towards the second end 232, terminating in a first intermediate edge 240. A second longitudinally extending surface 242 diverges from the first intermediate edge 240 and terminates in a second intermediate edge 244. A third longitudinally extending surface 246 diverges from the second intermediate edge 244 and terminates in a third intermediate edge 248. Diverging from the third intermediate edge 248 is a fourth longitudinally extending surface 250. The fourth longitudinally extending surface 250 terminates at the longitudinal edge 222. Each of the longitudinally extending surfaces 238, 242, 246, and 250 can be constructed and arranged to diverge from its corresponding edge at various increments, thus forming tapered areas as well as widened areas.

While the multi-purpose rotational barrier unit 200 may differ from the embodiment described previously based on the configurations of each of the side walls and bottom wall, the multi-purpose rotational barrier unit 200 contains each of the same features as described for the multi-purpose rotational barrier unit 10. It being understood that while some features are illustrated below, all features and their functionality which have been previously described applies to the embodiment illustrated as 200 and will not be described in detail. Moreover, any features newly described are equally applicable to any embodiments described herein. Referring to FIG. 14, the multi-purpose rotational barrier unit 200 contains: a filling access aperture 252 having the same features and functionality of the previously described filling access aperture 56 to aid the user in filling the hollow interior (refer to FIG. 15, 228) with water; a rotating member 254, preferably a ball and socket assembly constructed and arranged to provide angular or rotational motion about its center axis which is independent from the rotation of an adjacently attached second multi-purpose rotational barrier unit 10B to its front and/or back; and one or more attachments, including flotation devices 256, lifting hooks 258, eyelet hooks 260 having a weighted object 262 connected via a linked chain 264, and oil absorbent nets or assemblies, not illustrated. The multi-purpose rotational barrier unit 200 may optionally contain solid, integrally molded polyethylene end lips 266 which are preferably positioned at both ends of the unit, thus forming an equilateral triangle shape at the ends. The end lips 266 provide additional support when used in land based operations, but allow the device to maintain the same roll over resistant contour should the device be placed in aquatic environments. The end lips 266 may also contain a continuous recessed channel slot as described previously. In a more preferred, embodiment, the integrally molded polyethylene end lips 266 provide an air pocket 268. The air pocket 268 provides flotation and prevent roll over when used in both land and aquatic operations.

In use, the multi-purpose rotational barrier unit, referred to as 10, but represents any of the embodiments described or illustrated in the application, in combination with one or more of the attachments, i.e. weights, linked chains, flotation devices, oil absorbent structures, or nettings, are attached together in a manner as detailed previously to form an extended barrier system. Multi-purpose rotational barrier units of the same size can be attached together using many different units having different lengths, thus making use of readily available barrier units from local supplies. Because the barrier units can be manufactured in various lengths, any number of combinations of attached sequences can be formed. Moreover, individual multi-purpose rotational barrier units 10 can be attached together in variously numbered increments. For example, barrier units in 5-10 increments can be attached together and towed to potential spill sites by a number of small tow boats or by larger barges. Once at the site, the barrier unit increments can be connected to other barrier unit increments already at the location to form a larger barrier wall system. If needed, the barriers can be filled with water, either using sea water on site or through the use of fresh water stored on the transportation barges.

Figure 16:
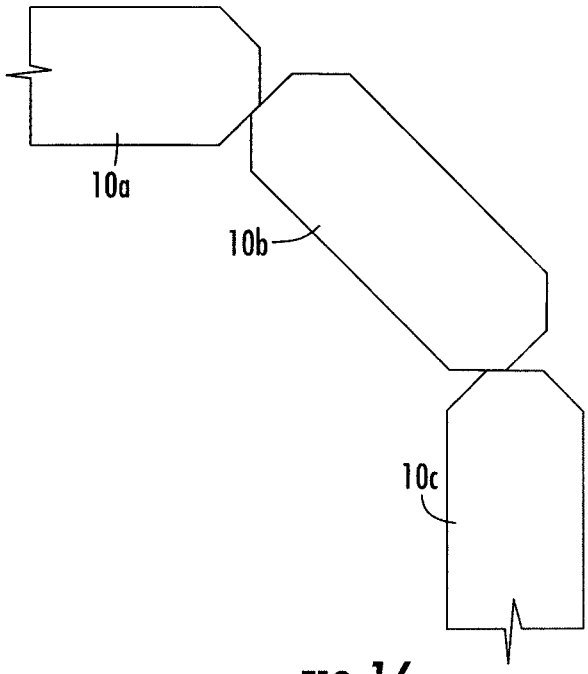
FIG. 16 is a block diagram illustration of a non-linear interconnection formation of a plurality of multi-purpose rotational barrier units of the instant invention.
Figure 17:
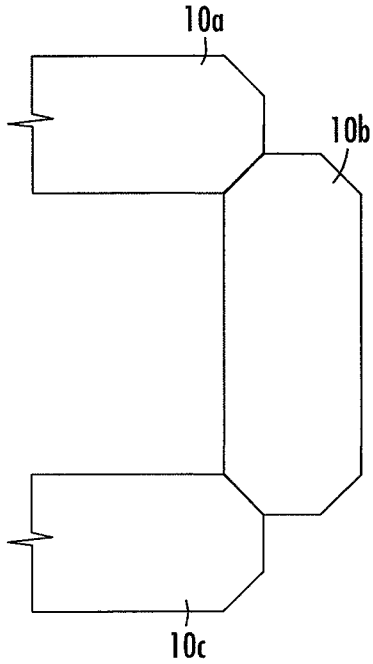
FIG. 17 is a block diagram illustration of an alternative manner of non-linear interconnection formation of a plurality of multi-purpose rotational barrier units of the instant invention.
Figure 18:
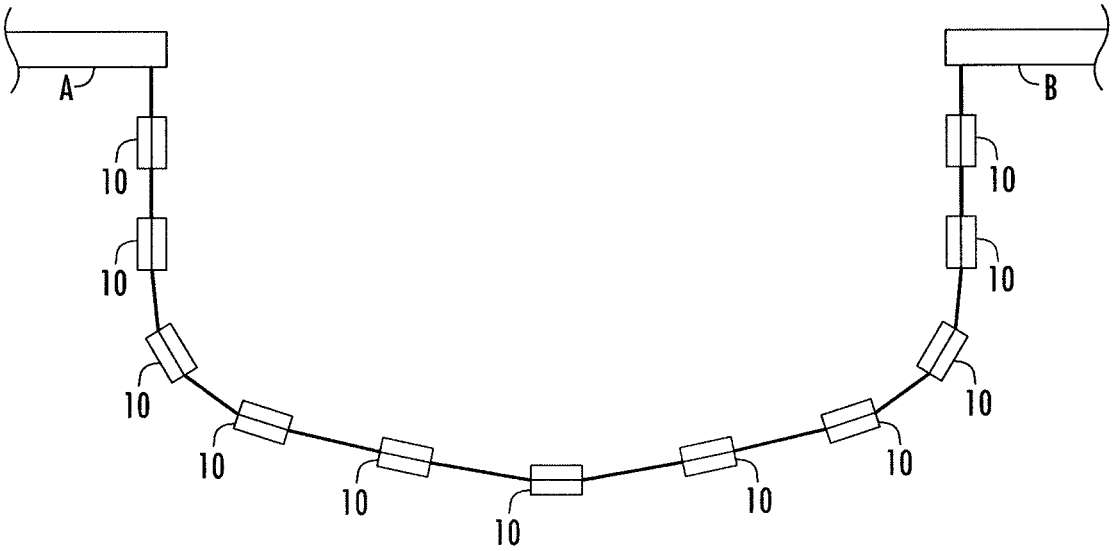
FIG. 18 is a block diagram illustration of the interconnection of a plurality of multi-purpose rotational barrier units of the instant invention to form a barrier wall assembly.

Connections of the barrier units are not limited to a linear format. Referring to FIG. 16, a plurality of multi-purpose rotational barriers units 10A, 10B, and 10C, illustrated in block form for simplicity, illustrate a 90 degree segmented bend between the barriers. FIG. 17 illustrates a plurality of multi-purpose rotational barriers units 10A, 10B, and 10C, connected together to form a 180 degree bend. As such, multiple barrier units can be attached together to meet curved containment radii incrementally. To aid in forming a tight connection in such formations, the barriers ends may contain an optional 45 degree bend. FIG. 18 illustrates a graphic depiction of numerous multi-purpose rotational barrier units connected together to form a 1000 feet barrier wall system. The barrier walls can be anchored to the sea floor using anchoring systems known to one of skill in the art, or to structures A and B, such as docks, posts, buoys, moorings, steel sheet piles, pre-cast concrete piles, or pressure treated wood piles. For shore line applications, steel sheet piles, precast concrete piles, or round pressure treated wood piles or moorings spaced 200 feet to 1000 feet on center could be used. The spacing can vary depending upon the size and length of the barrier units selected and the anticipated forces to be exerted on the barrier wall. The barrier wall system of the instant invention can be used 100 to 200 yards off shore along a beach or marsh coast line to reduce tar balls, oil spills on the beaches and other coastal environments.

The anchoring system is designed to accommodate a predetermined amount of force dependent on the wave/current forces the multi-purpose rotational barrier unit is designed to resist. It is anticipated that the drag forces of the current may cause the multi-purpose rotational barrier units 10 to form a parabolic shape as a result of tension force exerted upon the system. The tension forces are transferred to the piles in such a way so as to balance the net drag force acting on the barrier unit walls. It is anticipated that the tension force placed upon the barrier wall system of 1,000 feet in a 2 knot current perpendicular to the placement of the barrier walls, with piles or moorings spaced 400 feet on center, could reach well past 10,000 pounds. The tension force may also be carried into the vertical direction as the barrier units roll over as a result of wave actions, first at the lower edges then towards the upper edge. The location of the tension forces constantly shifts from the lower edge to the upper edge causing the barriers to destabilize and roll over in the waves. Because of the design features of the instant invention, the walls of the multi-purpose rotational barrier units are hydro dynamically stable in strong currents and high waves. While the individual barrier units are designed to roll over, the design of the equally shaped walls allows the units to maintain the same configuration integrity in the rolled over state, thus maintaining an ability to act as a barrier because the amount of material traveling between the two sides of the barrier is reduced.

In addition to being placed in open sea waters, the multi-purpose rotational barriers units can be placed at the mouth of inlets and lakes. The barriers can be used at boat docks facilities as a flotation wall and be placed around boat docks while they undergo construction or repair operations. They can further be used as temporary protective or guidance walls useful in off-loading and on-loading passengers. The multi-purpose rotational barriers units can be used at the sites of oil drilling platforms by connecting to cylindrical or the tri-pod steel girder truss support columns. To form larger diameter containment areas, additional structural girder support beams could be built or attached to the tri-pod columns. The multi-purpose rotational barrier units could then be connected to the beams to form a barrier around the oil rig platform. The multi-purpose rotational barrier units can also be attached to oil tankers leaking oil. By attaching the multi-purpose rotational barrier units to the ends of the ship, a floating barrier wall forms to minimize exposure of the leaking oil. Because of the design of the multi-purpose rotational barrier units, when not being used in aquatic environments, they can be utilized along a roadway or at construction sites to protect workers or other pedestrians. The barriers could be placed adjacent to roads or around excavation sites, and attached together using the dumbbell attachment devices, as described previously, or other securing means, such as steel iron pins/sleeves (not illustrated), between barriers if needed. To aid in stabilization, the multi-purpose rotational barriers units can be filled with water, sand, or salt, on site.

Figure 19A:
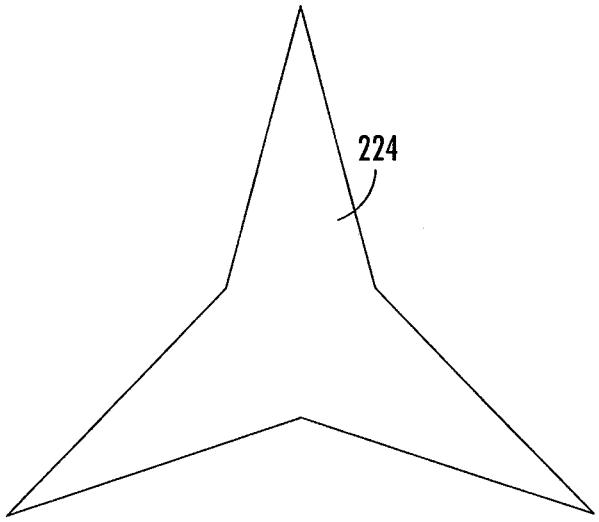
FIG. 19A is a front view of an alternative embodiment of the multi-purpose rotational barrier unit of the instant invention.
Figure 19B:
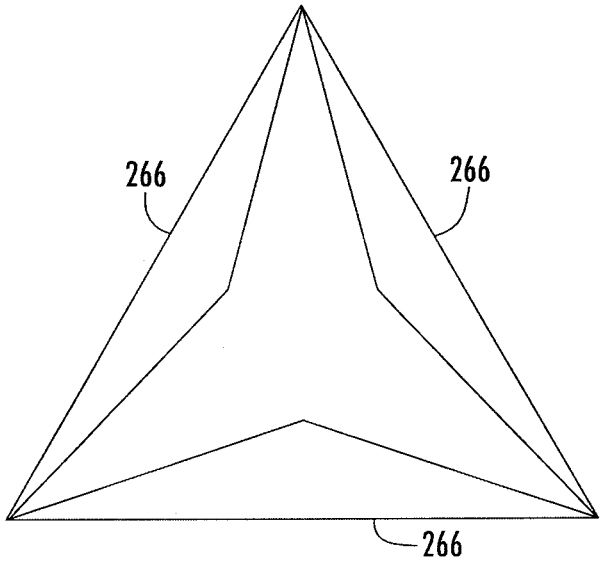
FIG. 19B is a front view of the alternative embodiment of the multi-purpose rotational barrier unit of the instant invention illustrated in FIG. 19A, with flange.
Figure 20A:
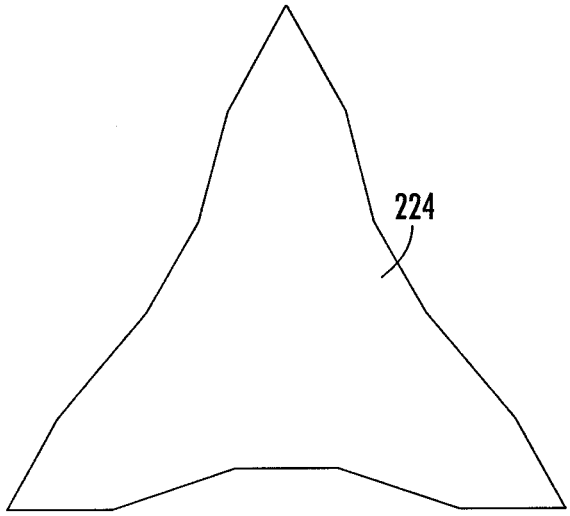
FIG. 20A is a front view of an alternative embodiment of the multi-purpose rotational barrier unit of the instant invention.
Figure 20B:
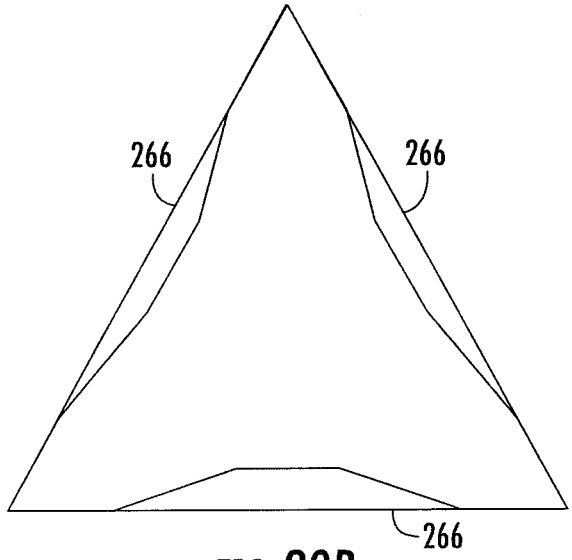
FIG. 20B is a front view of the alternative embodiment of the multi-purpose rotational barrier unit of the instant invention illustrated in FIG. 20A, with flange.
Figure 21A:
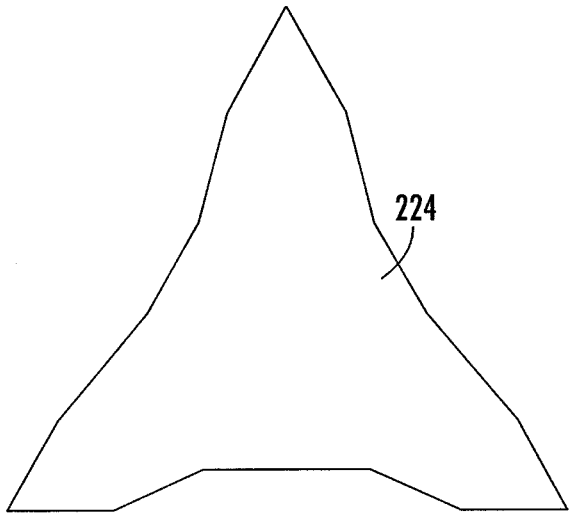
FIG. 21A is a front view of an alternative embodiment of the multi-purpose rotational barrier unit of the instant invention.
Figure 21B:
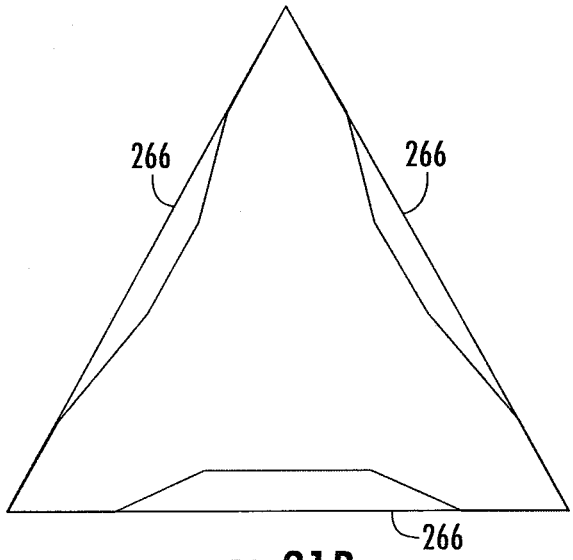
FIG. 21B is a front view of the alternative embodiment of the multi-purpose rotational barrier unit of the instant invention illustrated in FIG. 21A, with flange.
Figure 22A:
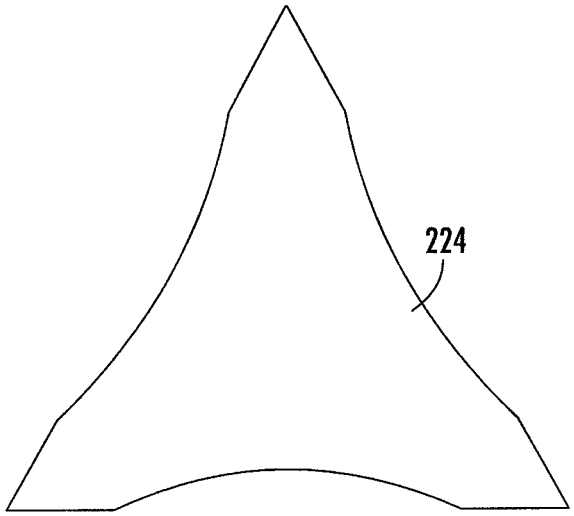
FIG. 22A is a front view of an alternative embodiment of the multi-purpose rotational barrier unit of the instant invention.
Figure 22B:
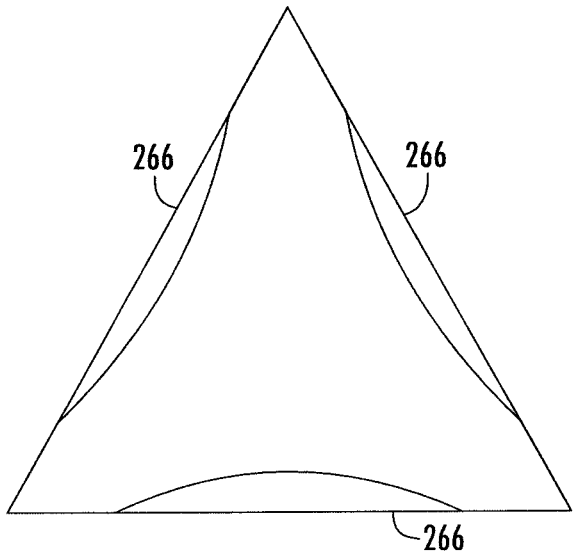
FIG. 22B is a front view of the alternative embodiment of the multi-purpose rotational barrier unit of the instant invention illustrated in FIG. 22A, with flange.

FIGS. 19-22 illustrate additional embodiments of the multi-purpose rotational barrier units. Each of the barrier units contain all of the elements described previously in describing the multi-purpose rotational barriers unit 10 or multi-purpose rotational barrier units 200, but differ in the cross sectional shape: two longitudinal segments per side wall, FIG. 19, illustrated with end lips, FIG. 19B; 5 longitudinal segments per side wall FIG. 20A, illustrated with end lips, FIG. 20B; 6 longitudinal segments per side wall FIG. 21, illustrated with end lips, FIG. 21B; and three longitudinal segments per side wall, with one of the segments having a curvature, FIG. 22A, illustrated with end lips, FIG. 22B.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A multi-purpose rotational barrier unit comprising:

a barrier unit adapted to function within a land-based or water-based environment having three equally sized and configured rigid walls interconnected to form two side walls and one bottom wall thus forming a generally triangular shape having a first top edge and two side edges, each said wall containing a plurality of longitudinally segmented surfaces which are constructed and arranged to maintain said barrier unit in a stable upright position or to dissipate side impact loads in an upward direction to lessen translational forces impacting said barrier unit thereby reducing the tendency of said barrier unit to roll over;

each said wall defined by a first segmented surface and a second, opposing segmented surface wherein said segmented surfaces form a generally planar surface to maintain said barrier unit in a stable, upright position when placed on a land or water surface thereby forming said wall, and a plurality of diverging segmented surfaces between said first and second segmented surfaces which intersect to form a gap between said first and second segmented surfaces when said barrier is placed on the land or water surface;

two opposing end walls connected to said equally sized and configured walls thus forming an interior; said opposing end walls containing one or more rotation members for providing rotational movement around at least one axis along said longitudinal axis of said at least one opposing end wall when connected on one or both ends with an adjacent barrier unit, said rotation members constructed and arranged to provide said barrier unit rotational movement along said longitudinal axis of said barrier unit which is independent from said movement of said adjacent barrier units;

whereby rotation of said barrier about said axis point results in said barrier maintaining its structural configuration in an upright position and maintaining the same configuration as said adjacent barrier.

2. The multi-purpose rotational barrier unit of claim 1 wherein said barrier unit further includes a linking member constructed and arranged to connect said barrier unit to an adjacent barrier unit.

3. The multi-purpose rotational barrier unit of claim 1 wherein said barrier unit further includes one or more attachment members.

4. The multi-purpose rotational barrier unit claim 3 wherein said attachment member is a weighted object.

5. The multi-purpose rotational barrier unit claim 3 wherein said attachment member is a flotation device.

6. The multi-purpose rotational barrier unit of claim 3 wherein said attachment member is an oil absorbent material.

7. The multi-purpose rotational barrier unit of claim 6 wherein said oil absorbent material is in the form of a net.

8. The multi-purpose rotational barrier unit of claim 7 wherein said oil absorbent net is attached to the top of the barrier unit, the bottom of the barrier unit, the walls of the barrier unit, or combinations thereof.

9. The multi-purpose rotational barrier unit of claim 6 wherein said oil absorbent material is attached to the top of the barrier unit, the bottom of the barrier unit, the walls of the barrier unit, or combinations thereof.

10. The multi-purpose rotational barrier unit of claim 3 wherein said attachment member is a material absorbent structure assembly, said material absorbent structure assembly constructed and arranged to rotate independently from said barrier unit about said center axis point.

11. The multi-purpose rotational barrier unit of claim 1 wherein said rotation member is a polyaxial joint.

12. The multi-purpose rotational barrier unit of claim 11 wherein said polyaxial joint is a ball and socket assembly.

13. The multi-purpose rotational barrier unit of claim 11 wherein said polyaxial joint is connected to an end lip, said end lip being constructed and arranged to provide each of the ends of the barrier unit with an equilateral triangular shape.

14. The multi-purpose rotational barrier unit of claim 13 wherein said end lip contains an air pocket.

15. The multi-purpose rotational barrier unit of claim 11 wherein said barrier unit contains a material absorbent structure assembly for minimizing the flow of a material between adjacently connected barrier units, said assembly constructed and arranged to rotate independently from said barrier unit about said center axis point.

16. The multi-purpose rotational barrier unit of claim 11 wherein said barrier unit contains one or more weighted objects.

17. The multi-purpose rotational barrier unit of claim 11 wherein said barrier unit contains one or more flotation devices.

18. The multi-purpose rotational barrier unit of claim 11 wherein said barrier unit contains one or more oil absorbent materials.

19. The multi-purpose rotational barrier unit of claim 18 wherein said oil absorbent material is in the form of a net.

20. The multi-purpose rotational barrier unit of claim 19 wherein said oil absorbent net is attached to the top of the barrier unit, the bottom of the barrier unit, along the said walls of the barrier unit, or combinations thereof.

* * * * *